US005421858A

United States Patent [19]

Smith

[11] Patent Number: 5,421,858

[45] Date of Patent: Jun. 6, 1995

[54] ORE FEED HEATING

[75] Inventor: C. Neil Smith, Bathurst, Canada

[73] Assignee: Novagold Resources Inc., Halifax, Canada

[21] Appl. No.: 79,973

[22] Filed: Jun. 18, 1993

Related U.S. Application Data

[63] Continuation of Ser. No. 811,322, Dec. 30, 1991.

[30] Foreign Application Priority Data

Oct. 30, 1991 [CA] Canada ..... 2054522

[51] Int. Cl.[6] ..... C21B 13/00

[52] U.S. Cl. ..... 75/746; 75/751

[58] Field of Search ..... 75/751, 746

[56] References Cited

U.S. PATENT DOCUMENTS

| | | | |
|---|---|---|---|
| 4,038,362 | 7/1977 | Guay . | |
| 4,256,706 | 3/1981 | Heinen . | |
| 4,259,107 | 3/1981 | Guay . | |
| 4,533,384 | 8/1985 | Rellermeyer | 75/751 |
| 4,552,589 | 11/1985 | Mason . | |
| 4,610,724 | 9/1986 | Weir . | |
| 4,723,998 | 2/1988 | O'Neil . | |
| 4,961,777 | 10/1990 | Perez . | |
| 4,979,986 | 12/1990 | Hill . | |

FOREIGN PATENT DOCUMENTS

| | | |
|---|---|---|
| 747847 | 12/1966 | Canada . |
| 950679 | 7/1974 | Canada . |
| 969763 | 6/1975 | Canada . |
| 990510 | 6/1976 | Canada . |
| 1044468 | 12/1978 | Canada . |
| 1052737 | 4/1979 | Canada . |
| 1234991 | 4/1988 | Canada . |
| 2001173 | 10/1989 | Canada . |

*Primary Examiner*—Peter D. Rosenberg
*Attorney, Agent, or Firm*—John P. White

[57] ABSTRACT

An improved method of extracting minerals from ore is described. The method is applicable to vat leaching operations and may also be useful in heap leaching operations. The method involves the pre-heating of comminuted ore prior to the agglomeration phase. The method is found to improve the quality of the agglomerate and to reduce the curing cycle time. In addition, the method described herein induces extra heat into the agglomerated mass which, as well as enhancing the agglomerate quality, adds heat to the leach solution resulting in higher mineral recoveries. The method is especially useful in the winter months when ore temperatures are low; however, improved results are realized when the method is used in the summer months as well.

17 Claims, 12 Drawing Sheets

ORE FEED HEATING

This is a continuation of application Ser. No. 07/811,322, filed Dec. 30, 1991.

The present invention pertains to improved methods of treating ore for extracting minerals therefrom.

BACKGROUND OF THE INVENTION

Various methods are known of extracting precious minerals from mined ores. Heap leaching and vat leaching are examples of such methods.

In the heap or vat leaching processes, the mined ore, or previously comminuted tailings, containing desired metal values such as, for example gold and silver, is usually crushed to particles of small diameter; some sandy materials, however, may not require crushing. The ore, comminuted if required, is then mixed with lime and/or cement plus a solution (usually water, or barren or pregnant solution from the leaching process) to form an agglomerate. The agglomerate can also be formed by mixing the ore with a sodium hydroxide solution or with water alone. In the case of heap leaching processes, the agglomerate is sometimes placed directly on a pad and allowed to cure. Alternatively, the agglomerate may be stacked in cones and allowed to cure prior to being placed on the pad. In vat leaching, the mixture is placed into a vat and allowed to cure although it may be cured prior to being placed in the vat. Curing time is characteristic to the type of ore being processed and may range from hours to days. Research has demonstrated that heat accelerates the curing process. Following the curing phase, a leaching solution is applied. The leaching solution, for example a cyanide solution, is normally sprayed onto the agglomerate and allowed to percolate through, in the course of which the desired metal values are leached out. The leach extract is then collected and the minerals are separated. The solution is then recycled for another application to the agglomerate. Heap leach methods, as described above, are known in the art. U.S. Pat. Nos. 4,256,706 (issued Mar. 17, 1981) and 4,961,777 (issued Oct. 9, 1990) are examples of prior art pertaining to heap leaching of gold and silver containing ores.

In heap or vat leach operations it has been found that metal recoveries are considerably lower in the winter season due to lower temperatures. In the case of vat leaching during winter months, the ore entering the plant is normally cold, thus requiring longer agglomerate curing times and resulting in weak cured agglomerates. When the leaching solution is applied to such weak agglomerates, they have been found to deform, or slump resulting in "channelling" of the leach solution through the agglomerate, thereby reducing the yield since the surface area of ore contacted by the leach solution is reduced. Further, such "weak" agglomerates retard the flow of the solution, which increases the cycle time, and increase the solution turbidity, which reduces recoveries. Further, high turbidity levels result excessive clarifier maintenance and increases the probability of turbid material passing beyond the clarifier and impairing the process downstream. Another problem associated with cold agglomerates lies in the finding that the leaching solution does not progress towards the optimal leaching temperature. In the case of cyanide leaching of gold, the optimum temperature has been determined as being 85° C.; however, the highest solution temperature achieved without additional heat and during the summer months is 24° C. and the highest solution temperature with added heat during the colder months is in the range of 30° C. The maximum operable working temperature for plant leach solution has yet to be determined; however, it is known that this value lies somewhere between 30° C. and 85° C. Condensation inside the building becomes a factor in making this determination.

In order to overcome the problems associated with inefficient agglomeration, attempts were made to heat the leach solution as opposed to the ore. This approach was discarded as it would not have any effect on the curing time or quality of the agglomerate since the solution is applied after the agglomeration phase. Further, engineering estimates indicated that the cost of heating the solution would be much higher than that required to heat the ore in order to achieve the same result.

SUMMARY OF THE INVENTION

The present invention addresses the above mentioned problems associated with heap and vat leach processes by providing a method for improving the quality of the agglomerate at the agglomeration phase. It is an objective of the present invention to provide an agglomerate which is more resistant to deformation and channelling thus allowing even exposure of the ore to the solution thereby leading to increased recoveries of metals, enhanced solution flow rates, reduced solution turbidity levels and a marked reduction in the curing times. The combined effect of the heat added to the ore and the heat of hydration generated during the curing phase elevates the solution temperatures beyond that obtained naturally.

The present invention provides, therefore, a method of enhancing the agglomeration of comminuted and other ores involving treatment of the ore with an agglomerating agent, wherein the method comprises the application of heat to the ore prior to said agglomeration.

The present invention also provides an improved ore leaching method. Specifically, the present invention discloses a method of improving the rate and amount of recovery of metal values from comminuted and other ores in a leaching process which includes an agglomeration step, wherein the ore is heated prior to the agglomeration step.

Further, the present invention provides a leaching process for extracting minerals from a comminuted ore comprising the steps of:

a) heating the comminuted ore;
b) mixing the ore with an appropriate agglomerating agent to form an agglomerate;
c) curing the agglomerate;
d) leaching said minerals from said agglomerate ore with a leaching solution; and
e) separating said minerals from said leaching solution.

The methods and processes of the present invention further result in a steady state leach solution temperature in the range of 25° C. to 85° C., and preferably in the range of 30° C. to 85° C.

BRIEF DESCRIPTION OF THE DRAWINGS

These and other features of the invention will become more apparent from the following description in which reference is made to the appended drawings wherein FIGS. 2–21 are referred to in the accompanying examples and wherein.

FIG. 2 illustrates charge curing times in relation to charge agglomeration temperature for the tests described in Example 1.

FIG. 3 illustrates the temperature versus cure time data from Example 1.

FIG. 4 illustrates the average charge temperature for various test runs described in Example 2.

FIG. 5 illustrates column leach test results from Example 2 for Au leaching.

FIG. 6 illustrates column leach test results from Example 2 for Ag leaching.

FIGS. 7–21 illustrate the data accumulated in the course of conducting the test runs for Example 1.

DETAILED DESCRIPTION OF THE PREFERRED EMBODIMENT

Figure 1:
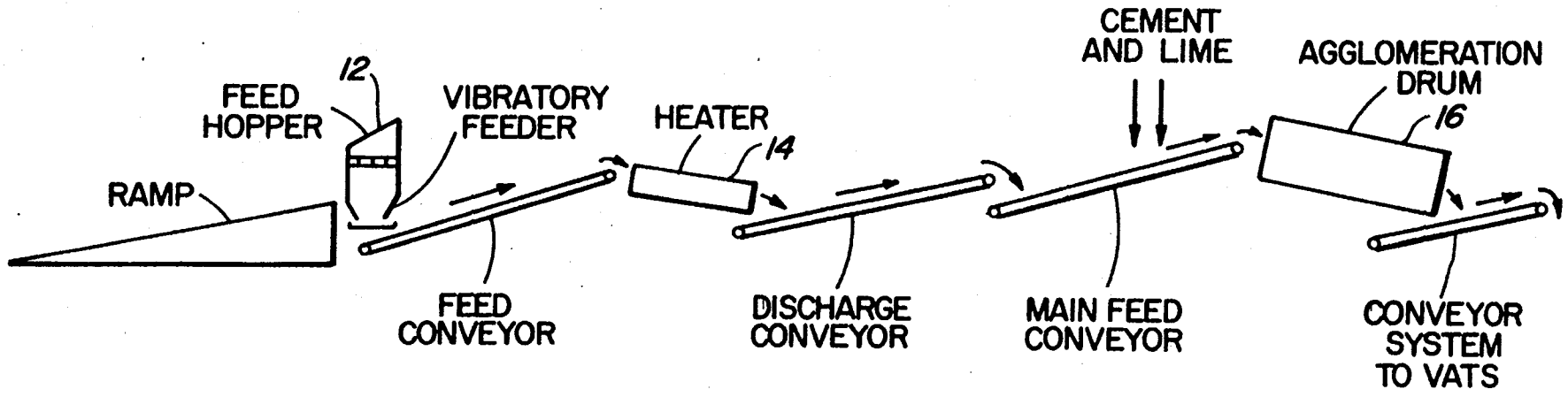
FIG. 1 is a schematic of the heap or vat leach process.

In the ore leaching process, an ore containing gold and/or silver is, if necessary, first comminuted into small particles and stockpiled. Ore from the stockpile is placed in a hopper 12 as shown in FIG. 1. The comminuted ore is then transferred by means of a conveyor to a heater 14 which heats the ore to a temperature between 14° C. and 60° C., the preferred range being 25° C. to 45° C. for humidity control at the site. The natural stockpiled ore temperature ranges between 0° C., in the winter, to as high as 14° C., in the summer. The heater can be an off-shelf unit, such as one designed for heating concrete aggregate, which can be adapted to the desired specifications. The heated material is mixed with an agglomerating agent and transferred by a conveyor to an agglomeration drum 16 where a leaching solution is added and further mixing takes place. Preferably, the agglomerating agent is a mixture of lime and/or cement plus water and/or leach solution; the water or leach solution is added to attain a desired moisture content. In addition to this agglomerating mixture, agglomerating agents may also be chosen from water alone or a sodium hydroxide solution. Following this, the agglomerate is placed on a heap, in the case of heap leaching, or in a vat, in the case of vat leaching and allowed to cure. A leach solution, such as a cyanide solution, is then sprayed onto the agglomerate and allowed to percolate through thereby leaching away the gold and/or silver contained in the ore. The minerals so obtained are then separated from the leach solution by methods known in the art. The leach solution is then recycled to be re-used over the agglomerate.

In the usual case, cold agglomerated material, having a temperature between 0° C. and 5° C. requires in excess of 24 hours to cure and results in high solution turbidity levels and weak agglomerates. However, when heated ore (having a temperature of about 30° C.) is used, these curing times are reduced to 8 to 10 hours, the resulting agglomerate is resistant to slumping and solution turbidity levels are negligible. The reduction in curing time results in a notable reduction in the process cycle time and/or allows for a longer leaching phase. The entrained heat and the naturally occurring heat from hydration aids the curing process and adds to and sustains a high solution temperature and flow rate which enhances recoveries of the said metals. As noted previously, some ores require longer curing times with respect to agglomeration.

It was also found that when the ore was pre-heated to 30° C. (that is before agglomeration) in the winter months the leach solution temperature was maintained at and above the highest temperatures achieved during the summer months (i.e. 24° C.). In practice, without pre-heating of the ore, the ore entered the plant in winter at 0° C. and the temperature of the leach solution was usually under 10° C. This increase in the solution temperature is due to the heat of hydration produced in the agglomerate during the curing cycle. By heating the ore as described above, it has been determined that solution temperatures in excess of 25° C. can be maintained without the expense of heating the solution separately. Such higher solution temperatures, such as in the range of 25° C. to 85° C. (and preferably 30° C. to 85° C.), accelerate the rate of dissolution of minerals into the leach solution. Further, in leaching gold and silver using the Merrill-Crowe system it is necessary to remove oxygen from the solution, prior to precipitation of the metals. When solution temperatures are low (at or below 10° C.) the oxygen content is high and it is extremely difficult, if at all possible, to remove the oxygen from solution. On the other hand, solutions of higher temperatures carry less oxygen and such dissolved oxygen is easier to remove.

Further, by preheating the ore, the leach extract was found to be relatively less turbid than in a process where the ore was not heated. This reduces the need for extra maintenance of the solution clarifiers and, therefore, reduces the cycle time of the solution. It is also known that turbid solutions impair recovery of metals at the precipitation phase. With excessive turbidity there is a strong possibility of the turbidity migrating beyond the clarifier.

In summary, ore heating prior to agglomeration enhances the agglomeration curing cycle time; results in a stronger agglomerate which does not break down under high solution flow rates thus avoiding the problem of channelling and controlling the solution turbidity; elevates the temperature of the agglomerated ore through the combination of induced heat plus the heat of hydration; this heat being transferred to the solution during leaching, thus enhancing the rate of dissolution of the metals and allowing dissolved oxygen to be more amenable to removal. All these factors lead to shorter cycle times of the leaching operation while yielding higher recoveries of gold and/or silver from the ore.

Although the present invention was developed to improve the decreased precious metal recoveries experienced during the winter months, similar improvements have also been realized when the method is applied during the summer months.

EXAMPLES

The following are the results of a series of tests conducted to study the Ore Feed Heating method. The tests were carried out on ore from the Murray Brook mine.

EXAMPLE 1

Agglomeration Tests

A total of 13 agglomeration tests were undertaken in two phases. The preliminary work (Phase 1) was followed up with an additional experimental series of tests ensuring that 13% moisture after agglomeration was maintained and that curing was carried out at varying temperatures in an oven. Six initial agglomeration tests were carried out in 100 kg batches at temperatures of 18°–56° C.

The standard procedure for these tests was as follows:

Approximately 100 kg of ore was heated to the desired temperature. The sample was agglomerated with 8 kg/tonne (16 lb/short ton) of lime and 5 kg/tonne (10 lb/short ton) of cement at approximately 13% moisture. The material was pub tack in the oven to maintain the temperature and allowed to cure. The degree of curing is checked at regular intervals by taking a small sample and wet screening it. The material was considered cured when few fines were produced.

Figure 2:
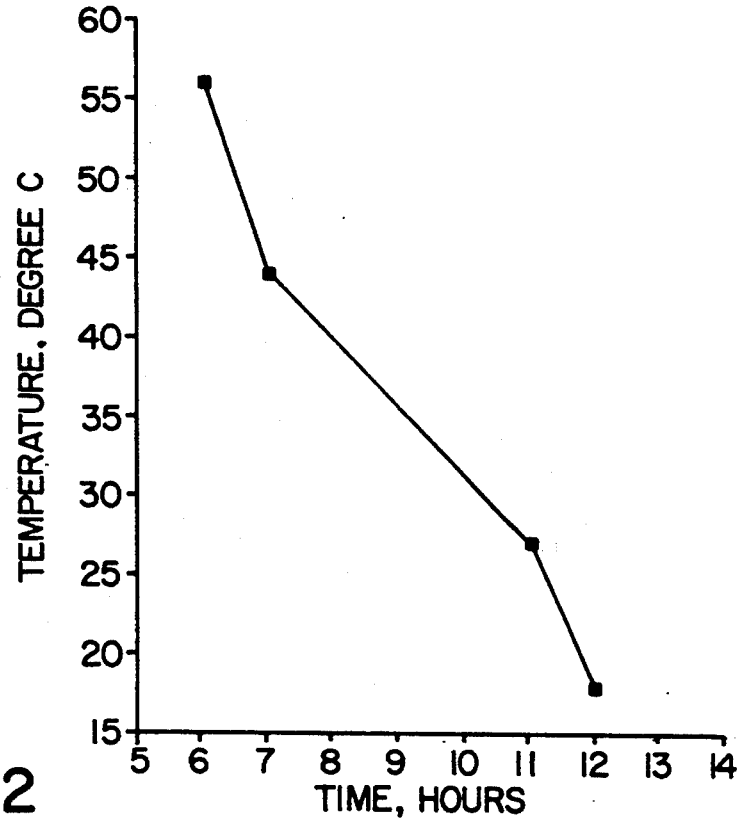

The test results (see Table 1) indicate that the agglomeration was satisfactory. A graph of agglomeration temperature versus time is illustrated in FIG. 2.

TABLE 1

| Charge Curing Times in Relation to Charge Agglomeration Temperature | | | |
|---|---|---|---|
| Run # | Temperature (°F.) | Temperature (°C.) | Cure Time (H) |
| 1 | 65 | 18 | 12 |
| 6 | 80 | 27 | 11 |
| 3 | 111 | 44 | 7 |
| 5 | 132 | 56 | 6 |

A reasonable relationship between curing time and temperature was established and confirms the plant findings in that approximately 12 hours is required for curing at ambient temperatures. Fines production during leaching operations appears to be practically nonexistent; this provides further support to the agglomeration tests being satisfactory. Curing times were reduced to six hours by increasing the temperature to 56° C.

Tests #2 and #4 were anomalous in curing time due to improper water addition prior to agglomeration.

Additional agglomeration tests were necessary to confirm the first trial data and verify that proper moisture level guidelines (e.g. 13–15%) had been maintained. Seven additional agglomeration tests were carried out in 20 kg batches at temperatures of 18°–60° C.

The procedure for these additional tests was somewhat different than that described previously in the initial work. Although reagent additions were the same (kg/tonne lime and 5 kg/tonne cement), the tests were carried out in 20 kg batches and exactly 13% moisture was added by weight. The material was heated to the desired temperature, agglomerated by tumbling in a 5 gallon pail for approximately 5 minutes and allowed to cure in a pile at temperature (oven cured). The drying ovens were modified to restrict air circulation by shutting off the fans. As in previous tests, the material was considered to be cured when few fines were produced during wet screening.

Figure 3:
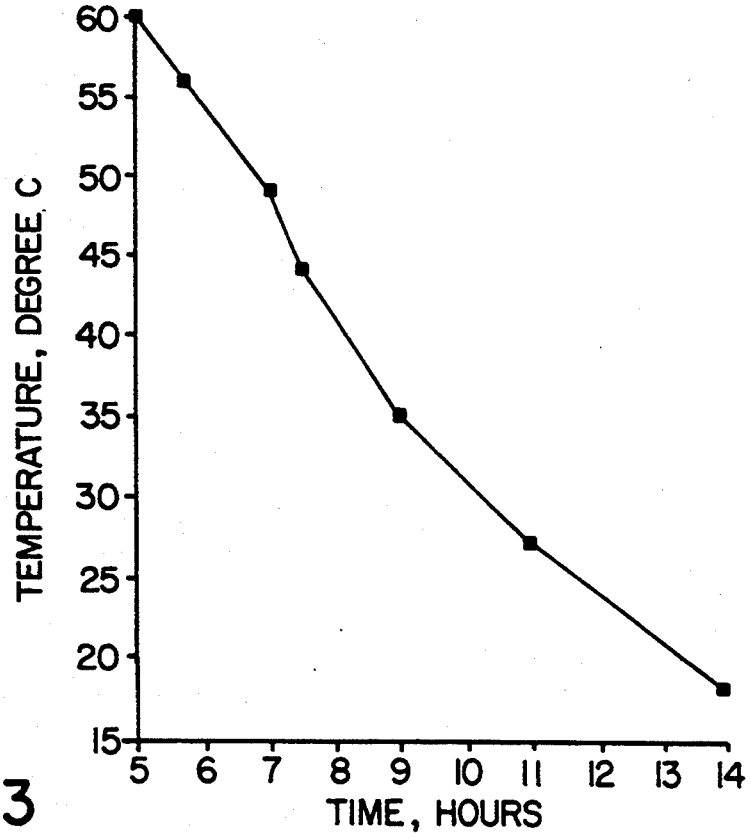

The results for these additional tests are listed in Table 2 and a graph of Agglomeration Temperature versus Time is illustrated in FIG. 3. The test results confirm the previous work cited in Table 1, however, slightly longer curing times were noted at ambient temperature (14 hours versus 12 hours at 18° C.).

TABLE 2

| Temperature Versus Cure Time Data: | | |
|---|---|---|
| TEMP (F.) | TEMP (C.) | CURE TIME (H) |
| 65 | 18 | 14 |
| 80 | 27 | 11 |
| 95 | 35 | 9 |
| 111 | 44 | 7.5 |
| 120 | 49 | 7 |
| 132 | 56 | 5.67 |

TABLE 2-continued

| Temperature Versus Cure Time Data: | | |
|---|---|---|
| TEMP (F.) | TEMP (C.) | CURE TIME (H) |
| 140 | 60 | 5 |

EXAMPLE 2

Simulated Vat Leach Tests

A total of 10 simulated vat leach tests were carried out in two Phases. Process optimization in the initial 6 tests indicated that best results were obtained in a flooded column.

A 6 foot high by 12 inch diameter column was utilized to simulate the Murray Brook vat leach. Samples from the agglomeration tests were transferred to the leach column where calcium cyanide solution (heated to the curing temperature) was applied to the top of the column. The initial cyanide ($CN^-$) level was 700 mg/L. Solution feed rate was approximately 350 mls/min. (which is equivalent to 5.9 gallons/sq.ft./hr.). Solution temperature in the sump and temperatures at the top, middle and bottom of the bed were recorded by thermocouples and were monitored continuously on a Kay data logger (Appendix I).

Solution samples were collected from the column discharge in the initial process optimization testing (1–6) and assayed for gold and silver (Appendix II). In addition, cyanide levels were checked and the oxygen content was monitored throughout the leach.

Preliminary cyanide leaching (tests 1–6) was carried out at nominal temperatures of 20° C., 30° C., 40° C. and 50° C. (Actual 21, 33, 36, 30, 28, 48). A total of six initial process optimization leaches were run.. Factors which affect gold recovery include cyanide level in solution, oxygen availability, agglomerate % $H_2O$) gold cyanide contact, solution flowrate, and temperature. Cyanide and oxygen content of the leach solution were monitored and appeared to be adequate. Initial tests (#1 and #2) indicated lower than expected extraction rates from solution assays and suggested poor gold-cyanide contact in the simulated vat leach.

Additional cyanide leach testing (Tests #3–6) was therefore carried out with the primary objective of optimizing the operational conditions to achieve maximum gold extraction.

In tests #3 and #4, after 24 hours, the solution was drained, the column was left for approximately 12 hours and then the ore was leached again with fresh cyanide solution. In Test #5, the solution feed was modified by putting a fibreglass packing on top of the ore to better distribute the cyanide solution and in Test #6, the column was flooded, thereby giving total wetting oft the ore.

Initial head, agglomerated heads and leach residues from column tests were fire assayed for gold. Head assays varied from 1.26 to 1.40 g/tonne. One anomalous head assayed 2.1 g/tonne. Residue assays were high (0.5–0.8 g/tonne) and could not be utilized to establish leach efficiencies as no washing with fresh cyanide or rinsing with alkali solution took place after leaching. As conditions varied for all six tests, solution assays could not be used to determine extraction rates or efficiencies.

A bottle roll test was carried out in duplicate on a head sample assaying 1.33 g/tonne Au and 24 g/tonne Ag. Extraction rates of 83% Au and 41% Ag were obtained after a 48 hour leach eliminating concerns for the presence of refractory ore.

The initial process optimization testing (#'s 1–6) revealed that additional effort was required to monitor and control the various process variables. The leach circuit was improved by changing the temperature controller to allow for more precise temperature control during the simulated vat leach. Simulated leach tests were carried out at nominal temperatures of 20°, 30°, 40° and 50° C. (23°, 30°, 40°, 45° C. actual), on standard agglomerated and cured gossan samples. All test samples were agglomerated and cured at ambient temperature. The samples were leached for 24 hours in a flooded column with 1 g/l cyanide concentration and solution flow rate of 400 to 600 ml/min.

Figure 4:
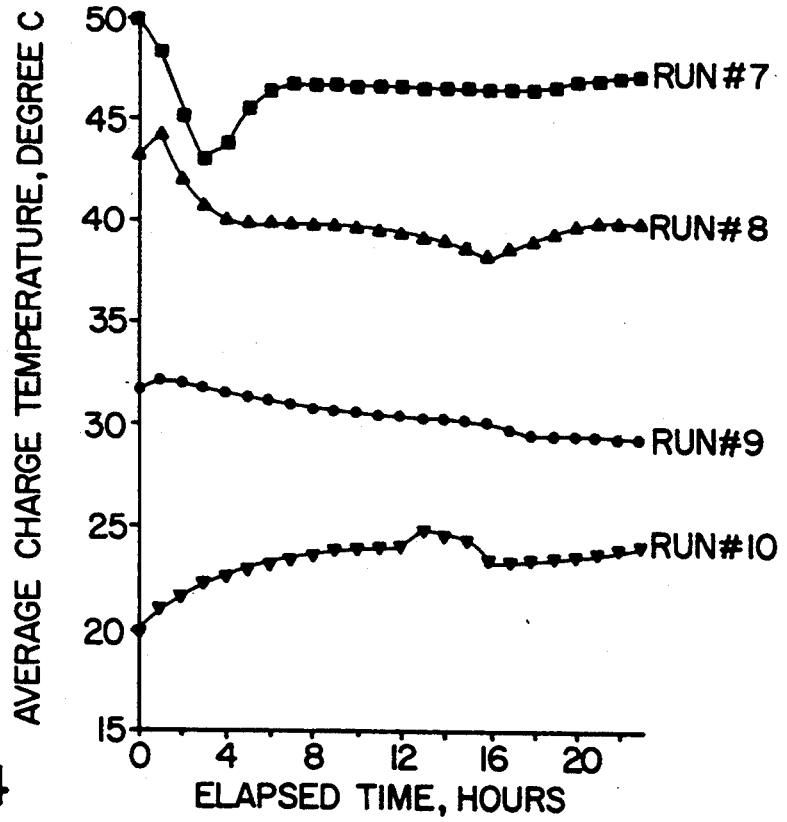

Average leach temperatures for the duration of tests #7–10 are given in Table 3 and illustrated in FIG. 4. The modifications to temperature control resulted in substantially improved control for all tests relative to the initial testing (#1–6) where significant changes in temperature were observed throughout the leach.

Figure 5:
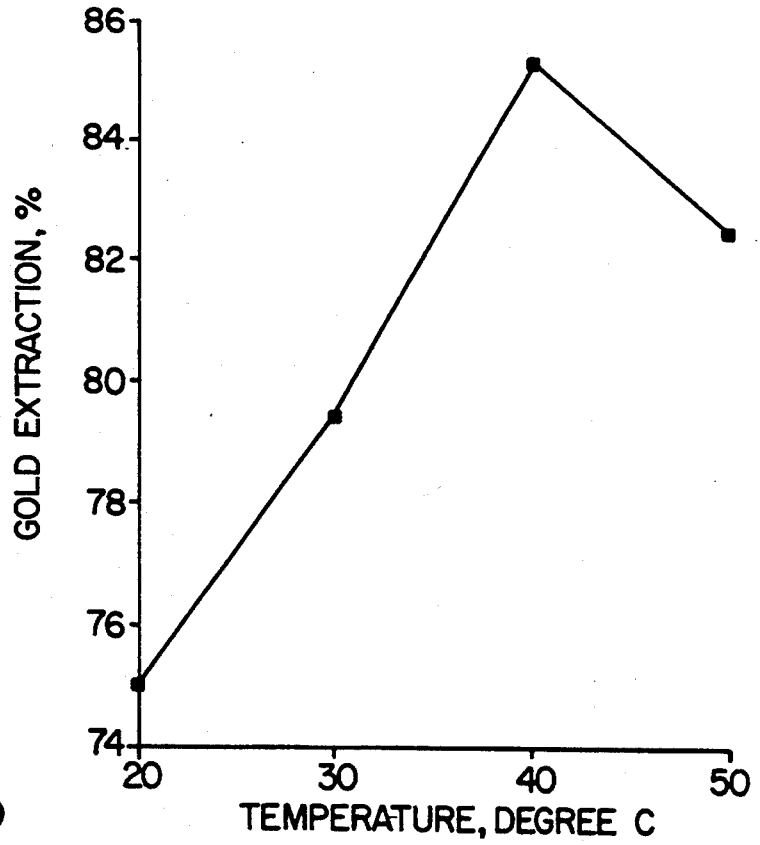
Figure 6:
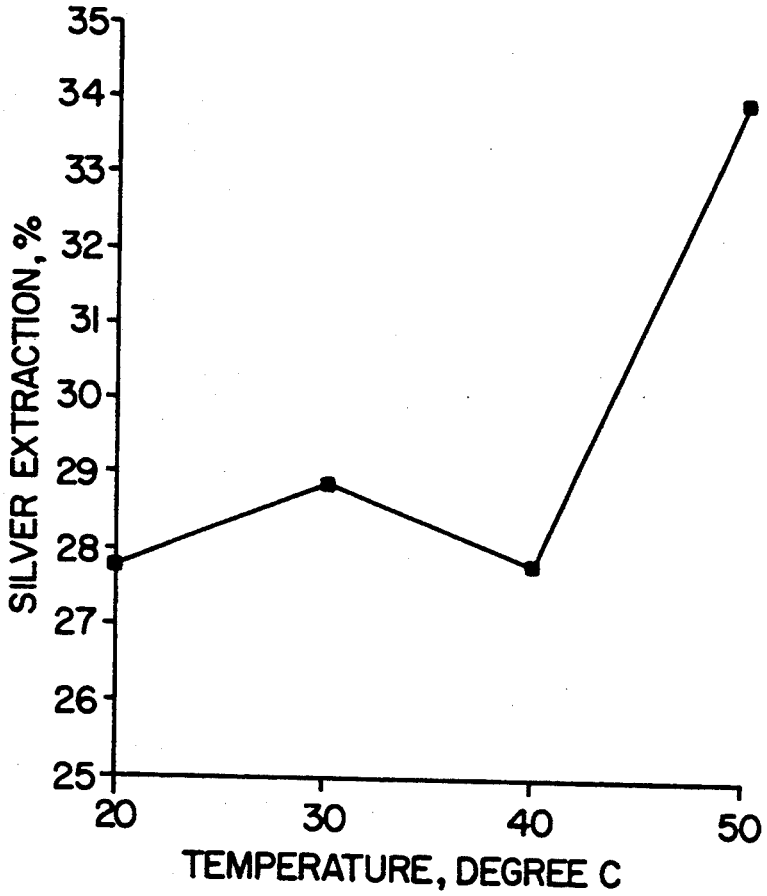

A 5 kg sample was split off from each of the leach residues. The sample was crushed wet and thoroughly washed to ensure removal of all residual leach solutions. A sample of the head and residue was fire assayed for Au and Ag. The results are listed in Table 4 and illustrated in FIGS. 5–6.

In general, gold extraction increased with increasing temperature. Averaged head assays were utilized in our calculations for proper interpretation of the test results due to their variability. A marked increase of 10% was noted at 40° C. from 20° C. The slight decrease in the gold extraction at 50° C. did not follow this trend.

The effect of increased temperature on silver extraction was not as clear, however, a marked improvement to 36.6% was noted at 50° C. Silver extractions were higher than those achieved at Murray Brook.

TABLE 3

| Average Charge Temperatures for Various Runs: | | | | |
|---|---|---|---|---|
| time(H) | RUN 7 | RUN 8 | RUN 9 | RUN 10 |
| 0 | 49.8 | 43.3 | 31.7 | 19.6 |
| 1 | 48.3 | 44.3 | 32.1 | 21 |
| 2 | 45.3 | 42 | 32 | 21.6 |
| 3 | 43.1 | 40.7 | 31.8 | 22.2 |
| 4 | 43.8 | 40 | 31.5 | 22.6 |
| 5 | 45.5 | 39.8 | 31.3 | 23 |
| 6 | 46.3 | 39.8 | 31.1 | 23.2 |
| 7 | 46.6 | 39.7 | 30.9 | 23.4 |
| 8 | 46.6 | 39.6 | 30.7 | 23.6 |
| 9 | 46.6 | 39.6 | 30.6 | 23.8 |
| 10 | 46.5 | 39.5 | 30.5 | 23.9 |
| 11 | 46.5 | 39.4 | 30.4 | 24 |
| 12 | 46.5 | 39.2 | 30.3 | 24 |
| 13 | 46.4 | 39 | 30.2 | 24.8 |
| 14 | 46.4 | 38.8 | 30.2 | 24.5 |
| 15 | 46.4 | 38.5 | 30.1 | 24.3 |
| 16 | 46.3 | 38.1 | 30 | 23.3 |
| 17 | 46.3 | 38.4 | 29.6 | 23.2 |
| 18 | 46.3 | 38.8 | 29.3 | 23.3 |
| 19 | 46.4 | 39.1 | 29.3 | 23.4 |
| 20 | 46.6 | 39.5 | 29.3 | 23.5 |
| 21 | 46.7 | 39.7 | 29.2 | 23.6 |

TABLE 3-continued

| Average Charge Temperatures for Various Runs: | | | | |
|---|---|---|---|---|
| time(H) | RUN 7 | RUN 8 | RUN 9 | RUN 10 |
| 22 | 46.8 | 39.7 | 29.1 | 23.8 |
| 23 | 46.9 | 39.7 | 29.1 | 23.9 |

TABLE 4

| Column Leach Test Results | | | | | |
|---|---|---|---|---|---|
| | | Au oz/t | | | EXT % |
| TEST | TEMP | HEAD | RESIDUE | EXT % | AVG HEAD |
| 7 | 50 | 0.05 | 0.012 | 76.0 | 82.4 |
| 8 | 40 | 0.077 | 0.01 | 87.0 | 85.3 |
| 9 | 30 | 0.069 | 0.014 | 79.7 | 79.4 |
| 10 | 20 | 0.076 | 0.017 | 77.6 | 75.0 |
| AVG | | 0.068 | | | |
| | | Ag oz/t | | | EXT % |
| TEST | TEMP | HEAD | RESIDUE | EXT % | AVG HEAD |
| 7 | 50 | 1.01 | .64 | 36.6 | 34.0 |
| 8 | 40 | 0.97 | .70 | 27.8 | 27.8 |
| 9 | 30 | 0.93 | .69 | 25.8 | 28.9 |
| 10 | 20 | 0.98 | .70 | 28.6 | 27.8 |
| AVG | | 0.97 | | | |

CONCLUSIONS AND RECOMMENDATIONS

The relationship between curing time versus temperature and leach extractions for gold versus temperature was established in this work. However, the effect on decreased curing time and associated aging times versus gold extraction was not demonstrated. An additional test program should be carried out to investigate the relationship between gold recovery and shorter curing times or aging. Reports in the technical literature indicate that shorter aging times leads to lower gold recoveries.

From our present program, it was clear that more meaningful test data would be generated if a mini pilot drum agglomeration and vat leach was set up and used for further test work. Such a facility would not be difficult to assemble as all the required equipment is already in existence. Once the facility is set up, it would be available to Murray Brook as required.

Our test program has also demonstrated that good washing of the ore after leaching is essential to optimizing recoveries especially with respect to silver extraction. A secondary wash circuit may benefit the process at Murray Brook.

To summarize, our test program demonstrated clearly that higher ore temperatures can result in decreased curing times and higher gold recoveries. As well, our studies indicate that improvements can be made to the process by additional test work especially if a mini-test facility which duplicates the Murray brook operation is used.

APPENDIX I

Solution Temperature in the Sump and Temperatures at the Top, Middle and Bottom of Bed

| | | | | RUN #1 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 17.4 | 16.9 | 16.8 | 17.7 | | | | |
| 1 | 17.7 | 17.8 | 17.9 | 18 | | | | |
| 2 | 18 | 18.2 | 18.3 | 18.4 | | | | |
| 3 | 18.5 | 18.7 | 18.8 | 18.9 | | | | |
| 4 | 18.9 | 19.1 | 19.2 | 19.3 | | | | |
| 5 | 19.4 | 19.6 | 19.7 | 19.8 | 2-1 | 18.51 | 19.80 | 16.80 |

-continued

| | | | | RUN #1 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 6 | 19.8 | 20 | 20.1 | 20.2 | 1-2 | 20.10 | 20.20 | 20.00 |
| 7 | 20.3 | 20.5 | 20.6 | 20.6 | | | | |
| 8 | 20.8 | 20.9 | 20.9 | 21.1 | | | | |
| 9 | 21.2 | 21.3 | 21.2 | 21.6 | | | | |
| 10 | 22.4 | 21.6 | 21.6 | 22 | | | | |
| 11 | 21.6 | 21.9 | 21.8 | 22.2 | | | | |
| 12 | 21.8 | 22 | 22.1 | 22.4 | | | | |
| 13 | 21.8 | 22 | 22.2 | 22.3 | | | | |
| 14 | 22.7 | 22 | 22.1 | 22.3 | 1-3 | 21.63 | 22.40 | 20.50 |
| 15 | 21.5 | 21.9 | 22.1 | 22.1 | | | | |
| 16 | 21.7 | 22 | 22.1 | 22.2 | | | | |
| 17 | 21.9 | 22.1 | 22.2 | 22.4 | | | | |
| 18 | 22 | 22.3 | 22.4 | 22.6 | | | | |
| 19 | 22.1 | 22.3 | 22.4 | 22.7 | | | | |
| 20 | 22.1 | 22.4 | 22.6 | 22.8 | | | | |
| 21 | 22.2 | 22.4 | 22.6 | 22.8 | | | | |
| 22 | 22.7 | 23.3 | 23.6 | 23.8 | | | | |
| 23 | 22.3 | 22.9 | 23.3 | 23.2 | | | | |
| 24 | 21.2 | 22.5 | 23 | 22.8 | 1-4//5 | 22.59 | 23.80 | 21.90 |
| 25 | 20.9 | 22.5 | 22.9 | 21.5 | | | | |
| | | AVERAGE SAMPLE TEMPERATURE IS | | | | 21.21 | | |

Figure 7:
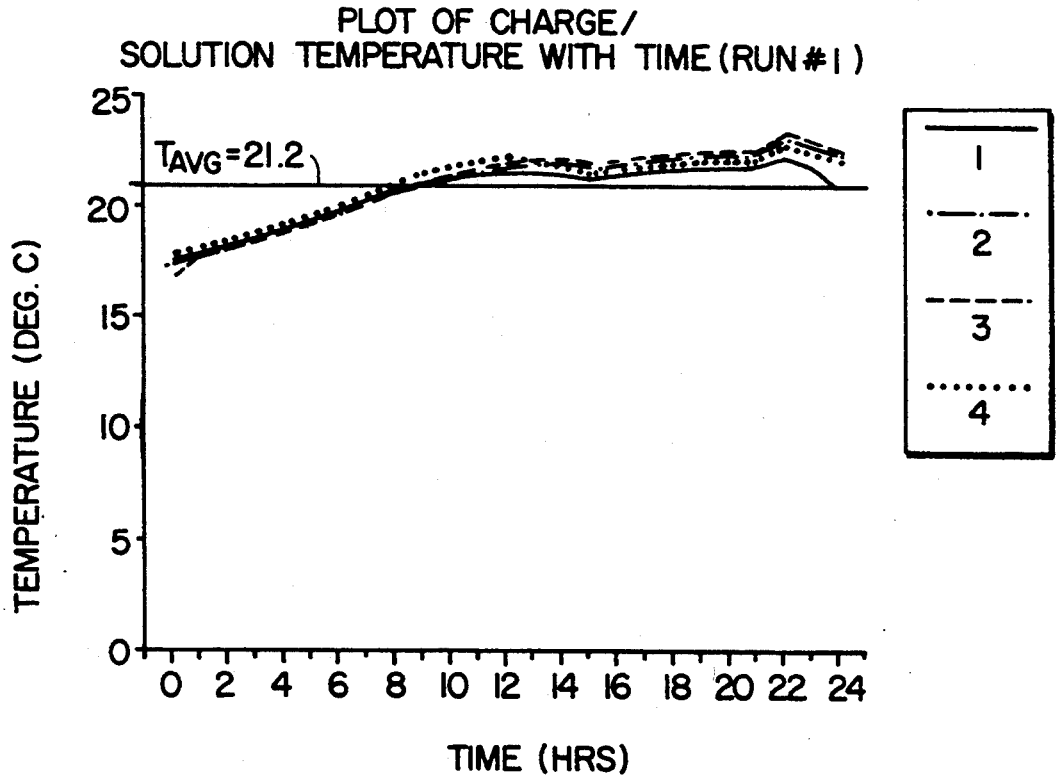

FIG. 7 illustrates a plot of charge/solution temperature against time for Run #1.

| | | | | RUN #2 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 54.9 | 56.4 | 60.7 | 61.1 | | | | |
| 1 | 45.3 | 54.8 | 55.6 | 39 | | | | |
| 2 | 40.4 | 46.8 | 46.3 | 34.1 | | | | |
| 3 | 36.6 | 41.9 | 40.2 | 31.4 | | | | |
| 4 | 33.4 | 37.6 | 36.1 | 29.1 | | | | |
| 5 | 30.8 | 34.2 | 33 | 27.2 | | | | |
| 6 | 28.6 | 31.4 | 30.5 | 25.6 | | | | |
| 7 | 26.9 | 29.2 | 28.5 | 24.2 | | | | |
| 8 | 25.6 | 27.6 | 27 | 23.2 | 2-1 | 37.51 | 61.10 | 23.20 |
| 9 | 24.7 | 26.2 | 25.7 | 23.2 | | | | |
| 10 | 23.8 | 25.1 | 24.7 | 22.8 | | | | |
| 11 | 23.2 | 24.3 | 24 | 22.4 | 2-2 | 24.27 | 26.20 | 22.40 |
| 12 | 22.7 | 23.6 | 23.4 | 22.1 | | | | |
| 13 | 22.3 | 23.1 | 22.8 | 21.7 | 2-3 | 22.78 | 23.60 | 21.70 |
| 14 | 21.9 | 22.6 | 22.4 | 21.4 | | | | |
| 15 | 21.6 | 22.3 | 22.1 | 21.2 | | | | |
| 16 | 21.2 | 22 | 21.8 | 20.4 | | | | |
| 17 | 20.6 | 21.5 | 21.3 | 19.8 | | | | |
| 18 | 43.4 | 21.1 | 22.8 | 33.3 | 2-4 | 22.40 | 33.30 | 19.80 |
| 19 | 52.8 | 28.5 | 31.6 | 44.9 | | | | |
| 20 | 54.8 | 36.2 | 45.8 | 48.7 | | | | |
| 21 | 61 | 40.2 | 47.8 | 45 | | | | |
| 22 | 38.7 | 42.2 | 40.4 | 33.2 | | | | |
| 23 | 54.8 | 39.8 | 46.5 | 42.5 | | | | |
| 24 | 37 | 40.8 | 38.6 | 32 | | | | |
| 25 | 40.8 | 38.1 | 36.5 | 34.3 | 2-5 | 39.70 | 48.70 | 32.00 |
| | | AVERAGE SAMPLE TEMPERATURE IS | | | | 32.53 | | |

Figure 8:
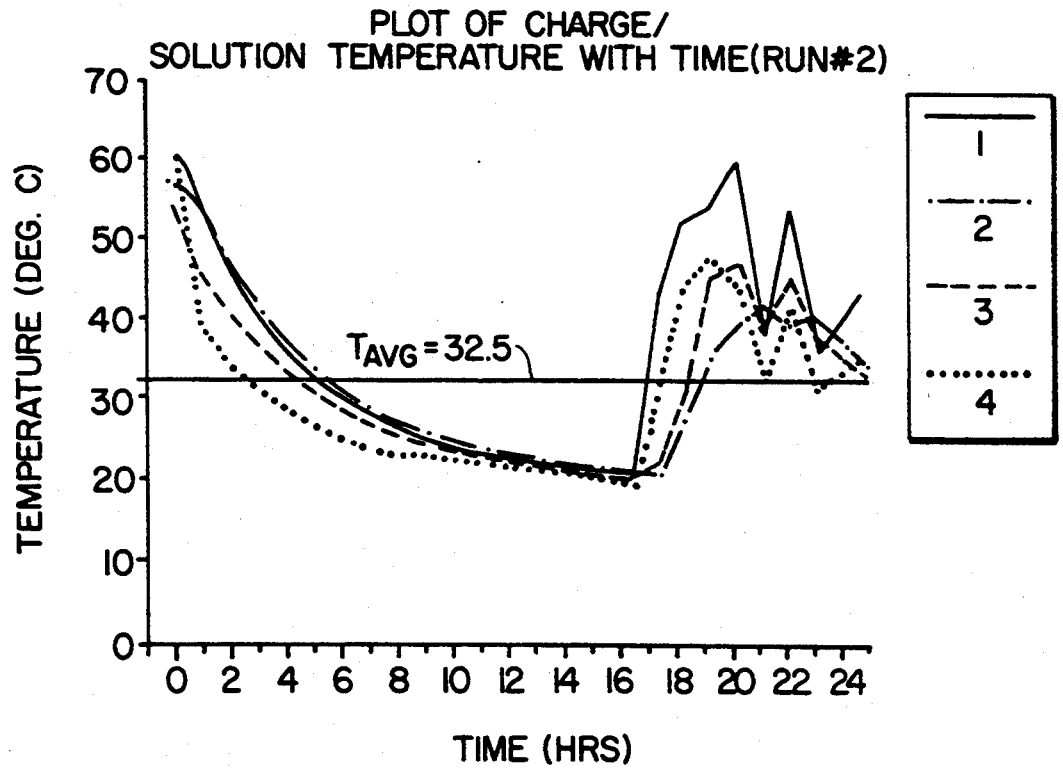

FIG. 8 illustrates a plot of charge/solution temperature against time for Run #2.

| | | | | RUN #3 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 40.7 | 38 | 40 | 39.3 | | | | |
| 1 | 57.3 | 38.8 | 49.1 | 35.9 | | | | |
| 2 | 48 | 54.5 | 47.8 | 32 | | | | |
| 3 | 41.4 | 43 | 40.5 | 29.8 | | | | |
| 4 | 38 | 38.8 | 37.1 | 28.7 | | | | |
| 5 | 62 | 38.3 | 51.9 | 35.7 | | | | |
| 6 | 47.2 | 53.8 | 46.6 | 32.8 | | | | |
| 7 | 41.2 | 42.5 | 39.9 | 31.7 | 3-1 | 40.27 | 54.5 | 28.7 |
| 8 | 37.5 | 38.4 | 36.6 | 28.7 | | | | |
| 9 | 47.2 | 35.6 | 37.7 | 30.8 | 3-2 | 34.63 | 38.4 | 28.7 |
| 10 | 50 | 53.5 | 50.3 | 34.1 | | | | |
| 11 | 41.4 | 43.6 | 40.2 | 30.5 | | | | |
| 12 | 37.3 | 38.4 | 36.4 | 28.3 | | | | |

-continued

| | | | | RUN #3 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 13 | 34.3 | 35.3 | 33.6 | 26.6 | | | | |
| 14 | 36.1 | 33.6 | 34.3 | 26.7 | | | | |
| 15 | 36.6 | 34.8 | 34.9 | 27.3 | | | | |
| 16 | 36.7 | 35 | 34.9 | 27.3 | 3-3 | 35.22 | 53.5 | 26.6 |
| 17 | 36.5 | 34.8 | 34.6 | 26.7 | | | | |
| 18 | 36.2 | 34.5 | 34.4 | 26.9 | | | | |
| 19 | 36.1 | 34.4 | 34.3 | 27 | 3-4 | 31.96 | 34.8 | 26.7 |
| 20 | 36.1 | 34.3 | 34.3 | 27.4 | | | | |
| 21 | 36.2 | 34.3 | 34.3 | 27.8 | 3-5 | 32.07 | 34.3 | 27.4 |
| 22 | 38 | 34.5 | 35.5 | 29 | | | | |
| 23 | 39.6 | 36.1 | 37 | 29.1 | | | | |
| 24 | 40.4 | 37.1 | 37.8 | 30.4 | 3-6 | 34.06 | 37.8 | 29 |
| | | AVERAGE SAMPLE TEMPERATURE IS | | | | 36.01 | | |

Figure 9:
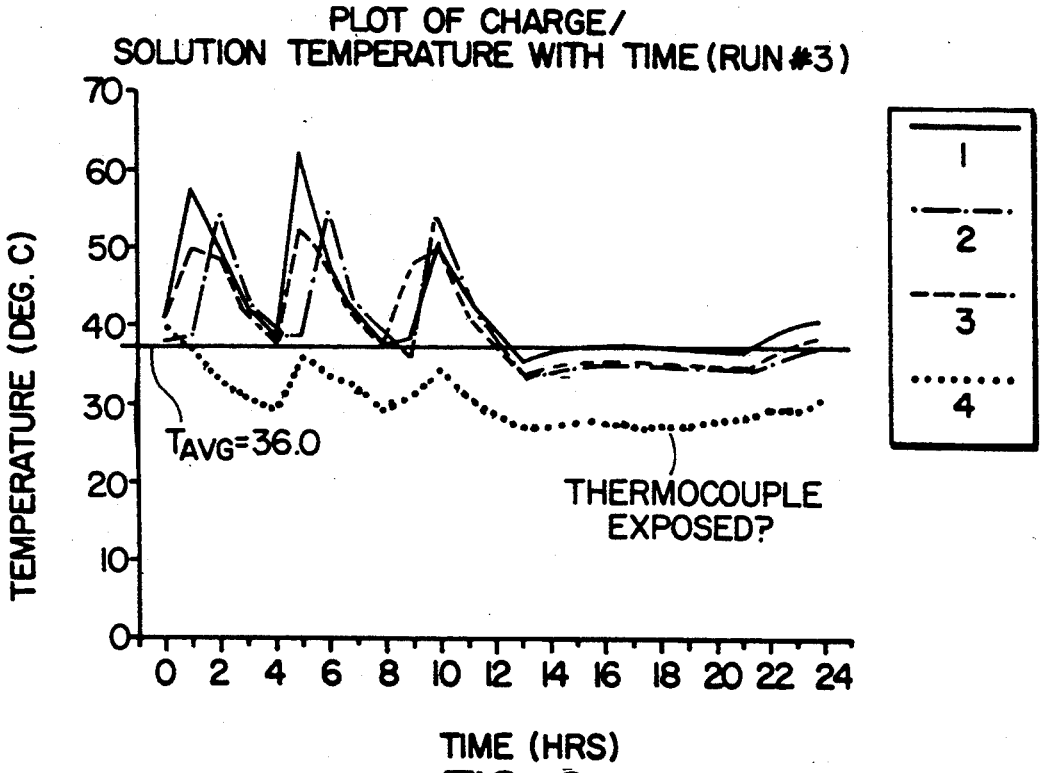

FIG. 9 illustrates a plot of charge/solution temperature against time for Run #3.

| | | | | RUN #3(a) | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 41.9 | 29.1 | 28.6 | 29.9 | | | | |
| 1 | 39.1 | 32.4 | 36.1 | 30.4 | | | | |
| 2 | 42.9 | 35.1 | 37.4 | 32.6 | 3--1 | 32.40 | 37.4 | 28.6 |
| 3 | 40.7 | 38 | 39.8 | 30.7 | 3--2 | 36.17 | 39.8 | 30.7 |
| 4 | 43.5 | 37.4 | 37.4 | 30.6 | | | | |
| 5 | 49.6 | 39.2 | 44.2 | 33 | | | | |
| 6 | 40.3 | 41.4 | 39.7 | 29.5 | | | | |
| 7 | 36.1 | 38.1 | 35.7 | 27.9 | | | | |
| 8 | 33.4 | 35.1 | 33.1 | 26 | 3--3 | 35.22 | 44.2 | 26 |
| 9 | 31.4 | 32.8 | 31.3 | 24.9 | | | | |
| 10 | 37.9 | 31.4 | 31.7 | 28.4 | | | | |
| 11 | 36.7 | 34.4 | 36.2 | 28 | | | | |
| 12 | 33.1 | 34.5 | 32.8 | 26.8 | | | | |
| 13 | 31.1 | 32.4 | 30.8 | 24.6 | 3--4//4 | 30.73 | 36.2 | 24.6 |
| 14 | 29.7 | 30.8 | 29.5 | 24.1 | | | | |
| 15 | 28.6 | 29.5 | 28.7 | 23.6 | | | | |
| 16 | 27.8 | 38.5 | 27.7 | 24.1 | | | | |
| 17 | 27.1 | 27.8 | 27.1 | 23.9 | | | | |
| 18 | 26.5 | 27.1 | 26.4 | 23.4 | | | | |
| 19 | 25.9 | 26.5 | 25.9 | 22.9 | | | | |
| 20 | 25.5 | 26 | 25.5 | 22.6 | | | | |
| 21 | 25.2 | 25.6 | 25.2 | 22.3 | | | | |
| 22 | 24.7 | 25.2 | 24.7 | 21.9 | | | | |
| 23 | 23.6 | 24.9 | 23.7 | 21.7 | | | | |
| 24 | 24.1 | 24.6 | 24.2 | 20.8 | 3--5//5 | 25.65 | 38.5 | 20.8 |
| | | AVERAGE SAMPLE TEMPERATURE IS | | | | 29.81 | | |

Figure 10:
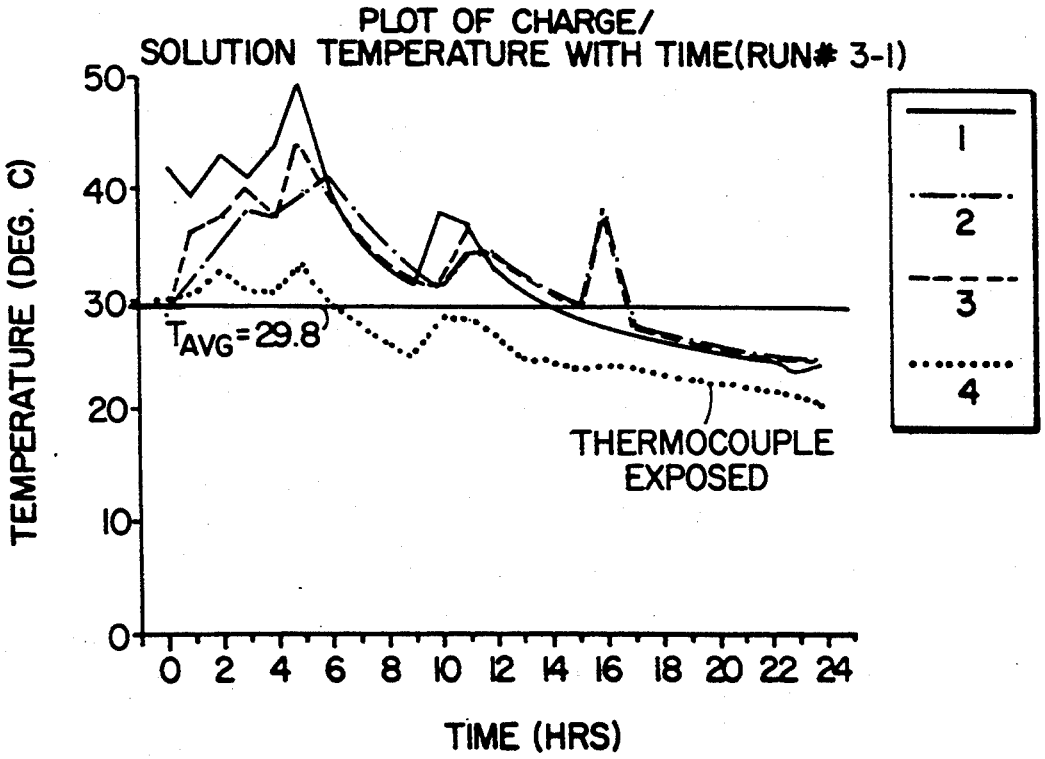

FIG. 10 illustrates a plot of charge/solution temperature against time for Run #3(*a*).

| | | | | RUN #4 | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 40.3 | 33.2 | 39.1 | 40 | | | | |
| 1 | 30.7 | 36.4 | 38.6 | 33.3 | | | | |
| 2 | 31.3 | 35.8 | 33.6 | 31 | | | | |
| 3 | 30.3 | 34.1 | 32.3 | 30.1 | 4-1 | 34.79 | 40 | 30.1 |
| 4 | 29.2 | 32.5 | 31.2 | 29.1 | | | | |
| 5 | 28.2 | 31.3 | 30.4 | 28.4 | | | | |
| 6 | 27.7 | 30.3 | 29.5 | 27.8 | | | | |
| 7 | 27.4 | 29.5 | 28.8 | 27.4 | | | | |
| 8 | 27 | 28.9 | 28.2 | 27.1 | | | | |
| 9 | 26.9 | 28.3 | 27.7 | 26.9 | 4-2 | 29.07 | 32.5 | 26.9 |
| 10 | 26.6 | 27.7 | 26.8 | 26.6 | | | | |
| 11 | 26.3 | 27.1 | 26.5 | 26.4 | | | | |
| 12 | 25.3 | 26.6 | 26.3 | 26.1 | | | | |
| 13 | 25.1 | 26.3 | 25.3 | 25.2 | | | | |
| 14 | 24.9 | 26.1 | 25.1 | 25 | | | | |
| 15 | 24.7 | 26 | 24.9 | 24.8 | | | | |
| 16 | 24.6 | 25.8 | 24.7 | 24.6 | | | | |
| 17 | 24.4 | 25.6 | 24.6 | 24.5 | | | | |
| 18 | 24.2 | 24.6 | 24.4 | 24.3 | | | | |
| 19 | 24 | 25.3 | 25 | 24.1 | 4-3 | 25.54 | 27.7 | 24.1 |
| 20 | 28.5 | 25.1 | 25.3 | 27.4 | | | | |
| 21 | 29.7 | 25.4 | 27.7 | 29 | | | | |

-continued

| RUN #4 | | | | | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 22 | 30.4 | 26.7 | 28.1 | 29.1 | | | | |
| 23 | 31 | 27.8 | 28.7 | 29.5 | 4-4//4 | 27.48 | 29.5 | 25.1 |
| | | AVERAGE SAMPLE TEMPERATURE IS | | | | 28.29 | | |

Figure 11:
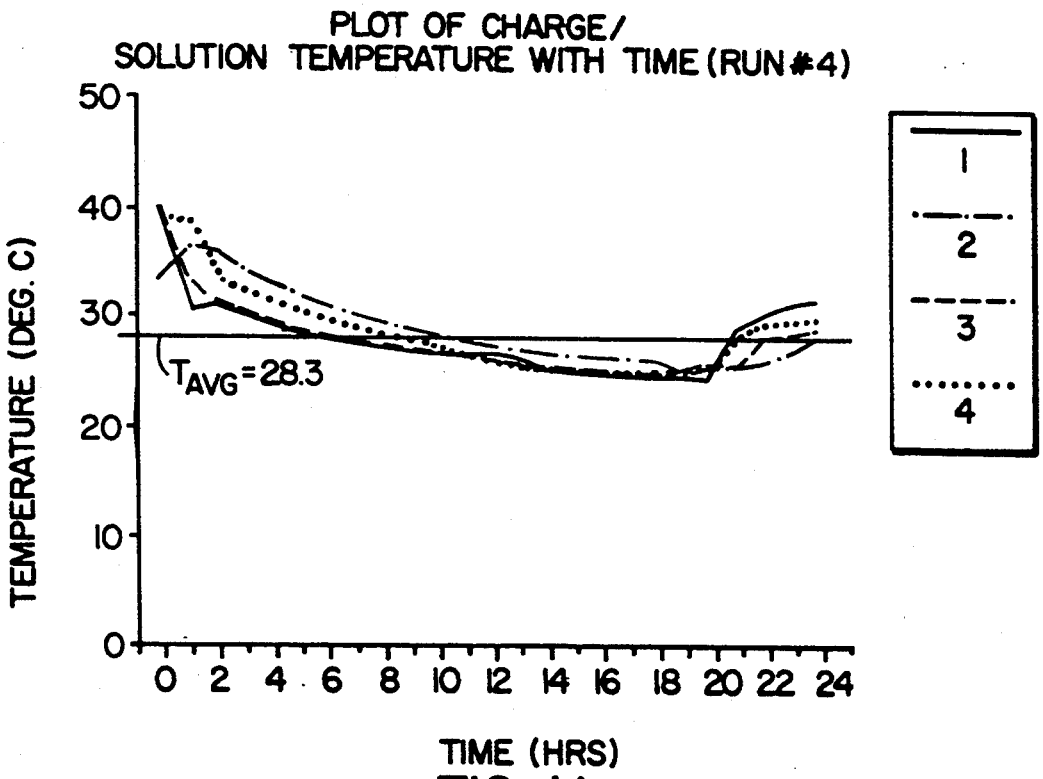

FIG. 11 illustrates a plot of charge/solution temperature against time for Run #4.

| RUN #4(a) | | | | | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 44.1 | 27.6 | 27.9 | 43.5 | | | | |
| 1 | 31.7 | 32 | 32.3 | 34.2 | 4--1 | 32.92 | 43.5 | 27.6 |
| 2 | 29.9 | 31.9 | 33.8 | 30.5 | | | | |
| 3 | 28.6 | 31.1 | 32.8 | 28.8 | 4--2 | 31.48 | 33.8 | 28.8 |
| 4 | 27.7 | 30.2 | 31.1 | 27.7 | | | | |
| 5 | 26.9 | 29.3 | 29.6 | 26.8 | | | | |
| 6 | 26.1 | 28.4 | 28.3 | 26.1 | | | | |
| 7 | 25.6 | 27.5 | 27.3 | 25.5 | | | | |
| 8 | 25.1 | 26.8 | 26.5 | 24.9 | | | | |
| 9 | 23.8 | 26.1 | 25.8 | 23.6 | | | | |
| 10 | 24.1 | 25.7 | 25.5 | 24.2 | | | | |
| 11 | 26.5 | 25 | 24.8 | 23.4 | 4--3 | 26.67 | 31.1 | 23.4 |
| 12 | 25.2 | 24.8 | 24.3 | 25.7 | 4--4//4 | 24.93 | 25.7 | 24.3 |
| | | AVERAGE SAMPLE TEMPERATURE IS | | | | 28.24 | | |

Figure 12:
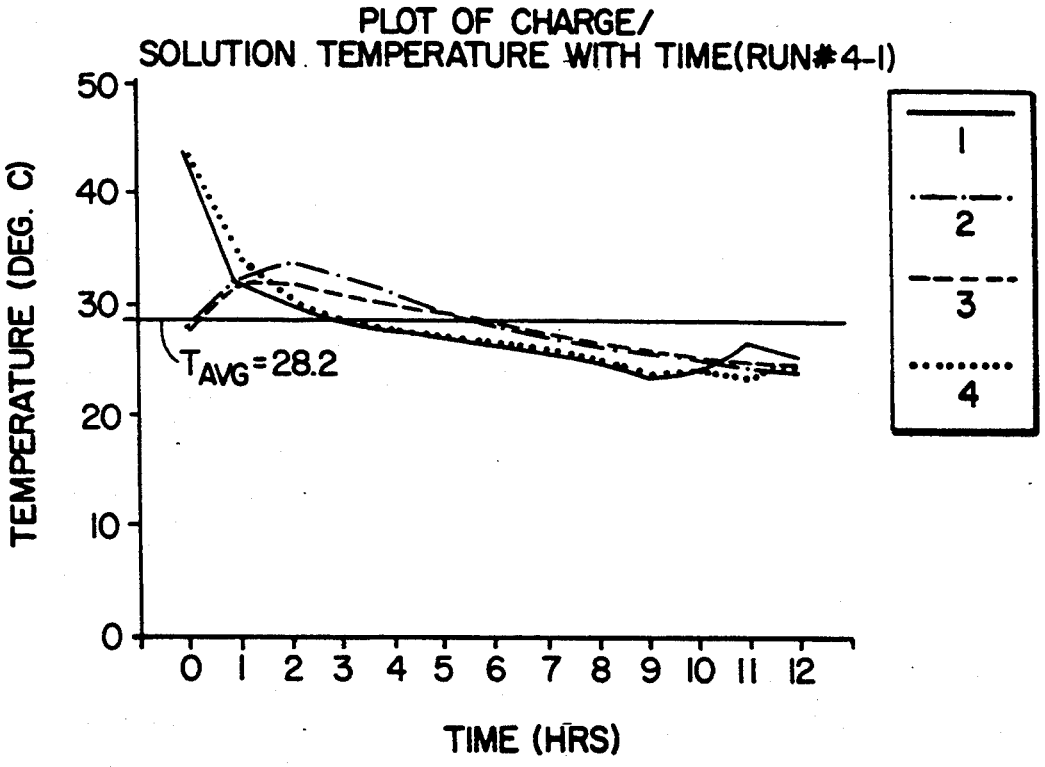

FIG. 12 illustrates a plot of charge/solution temperature against time for Run #4(*a*).

Figure 13:
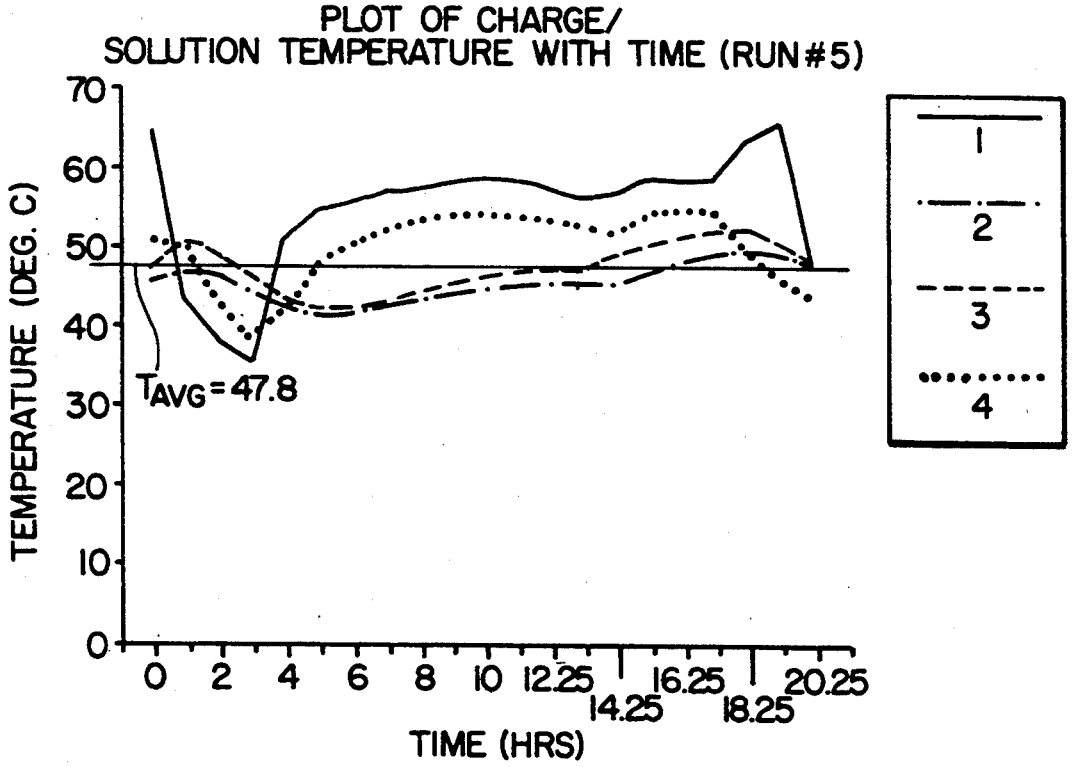
Figure 14:
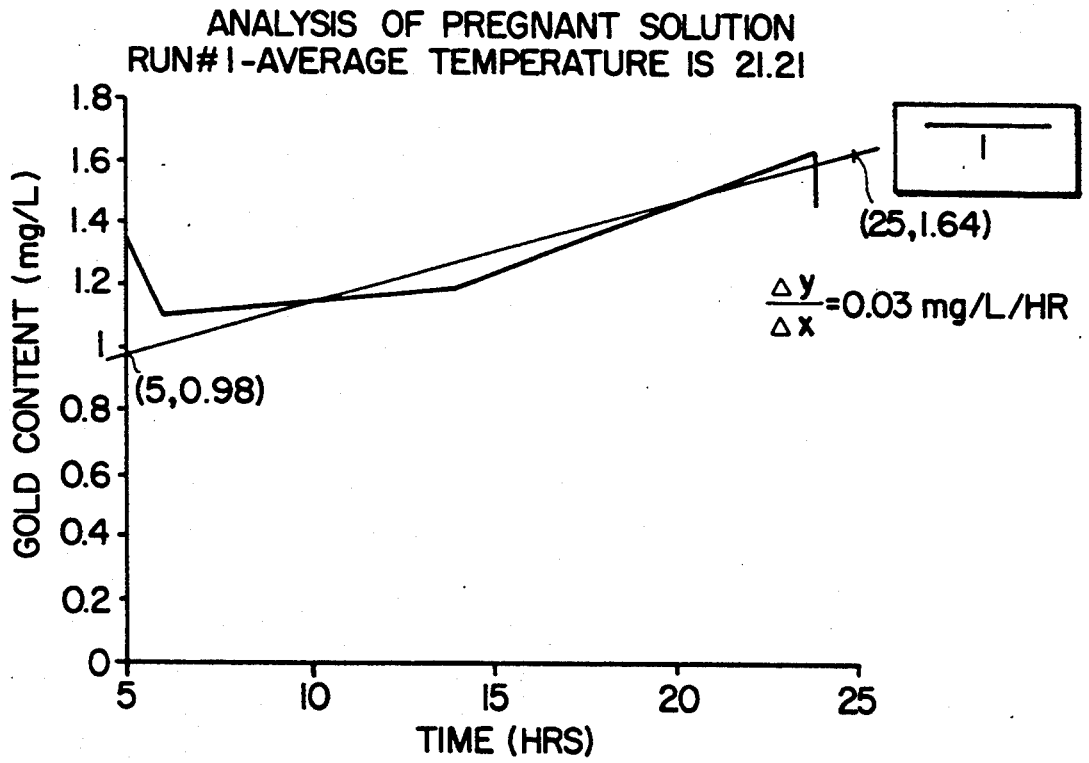
Figure 15:
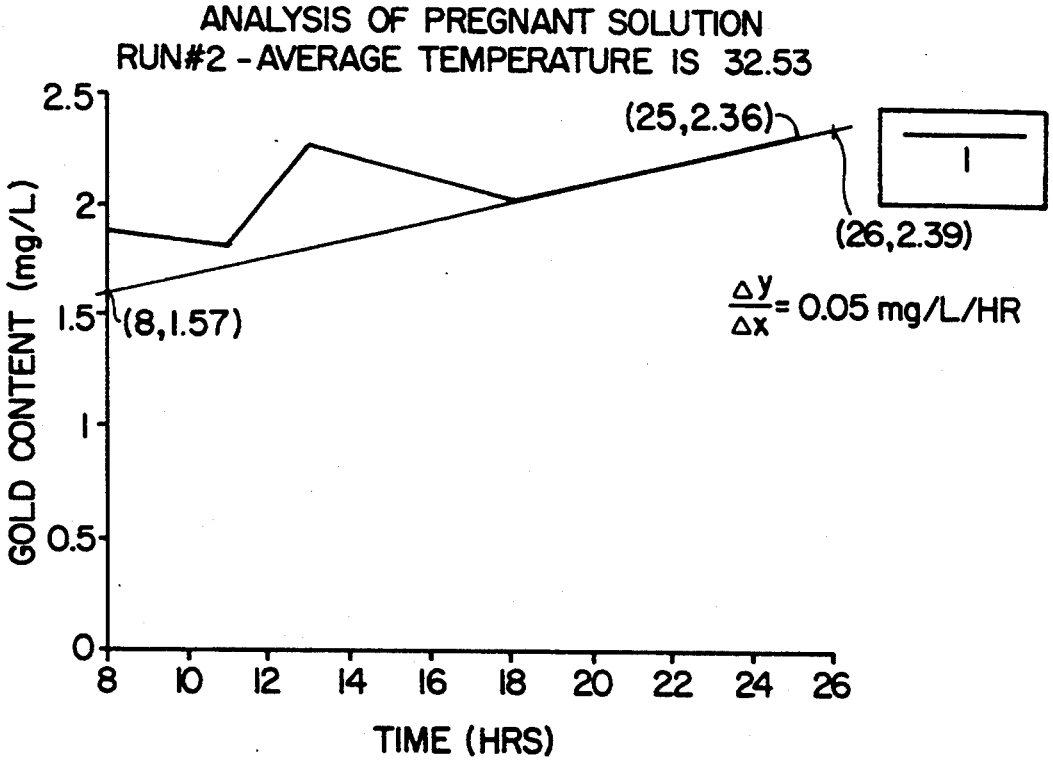
Figure 16:
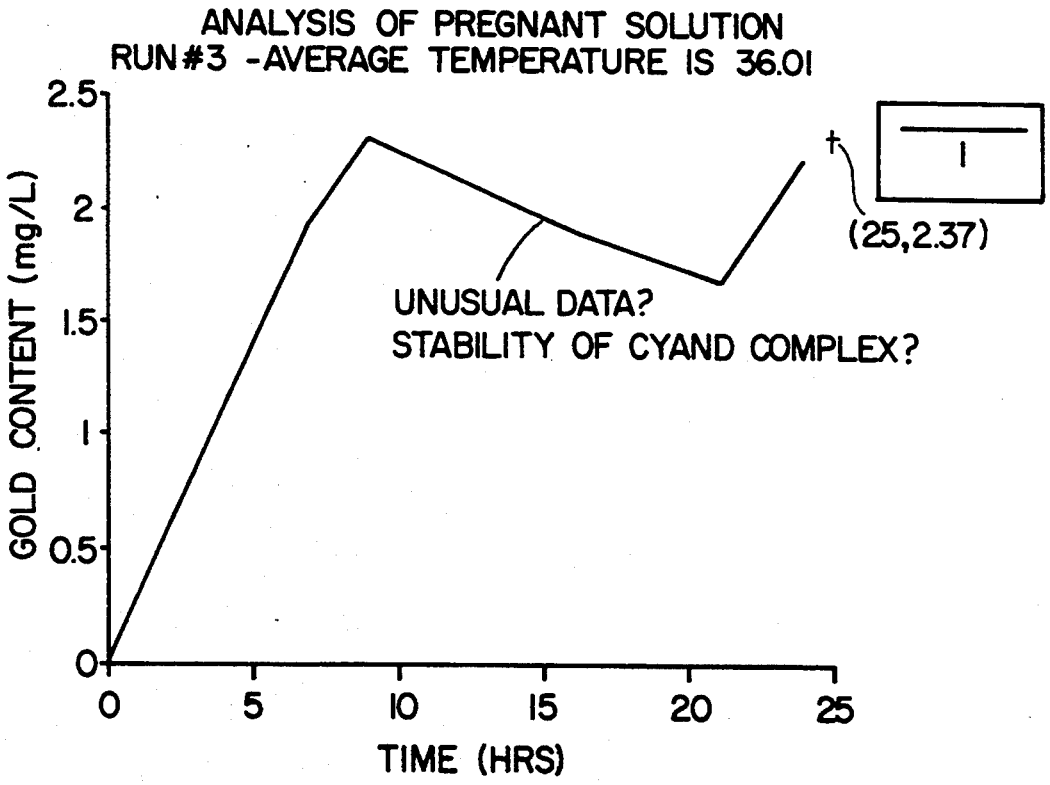
Figure 17:
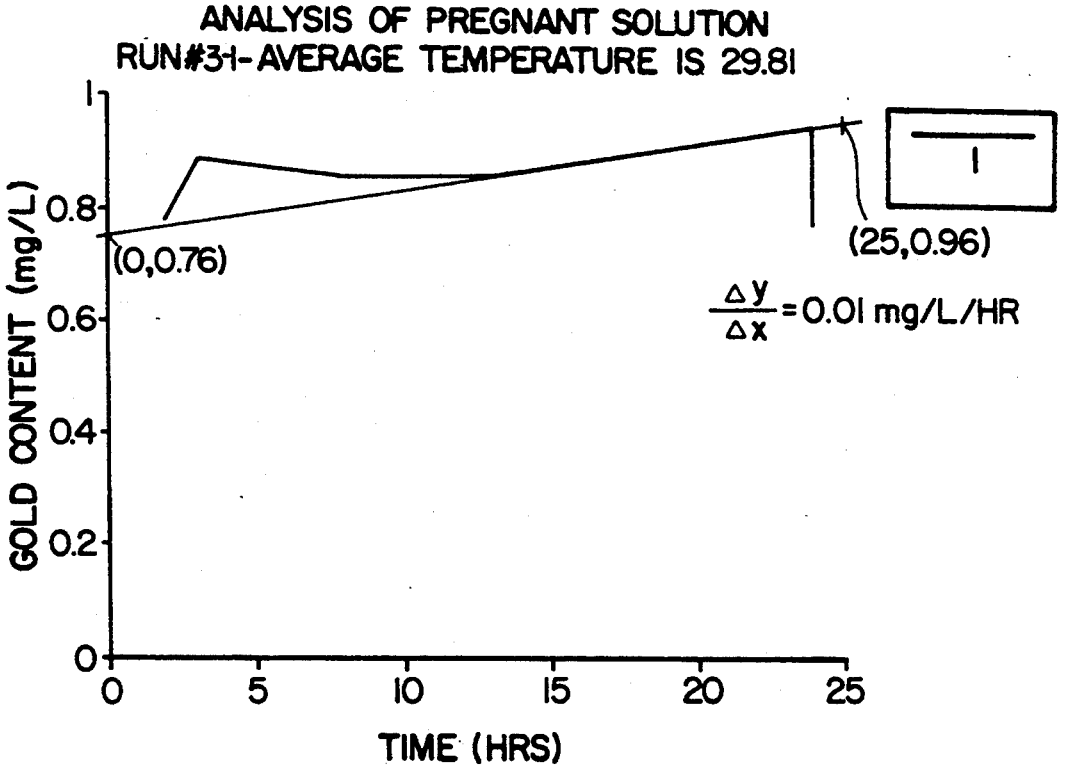
Figure 18:
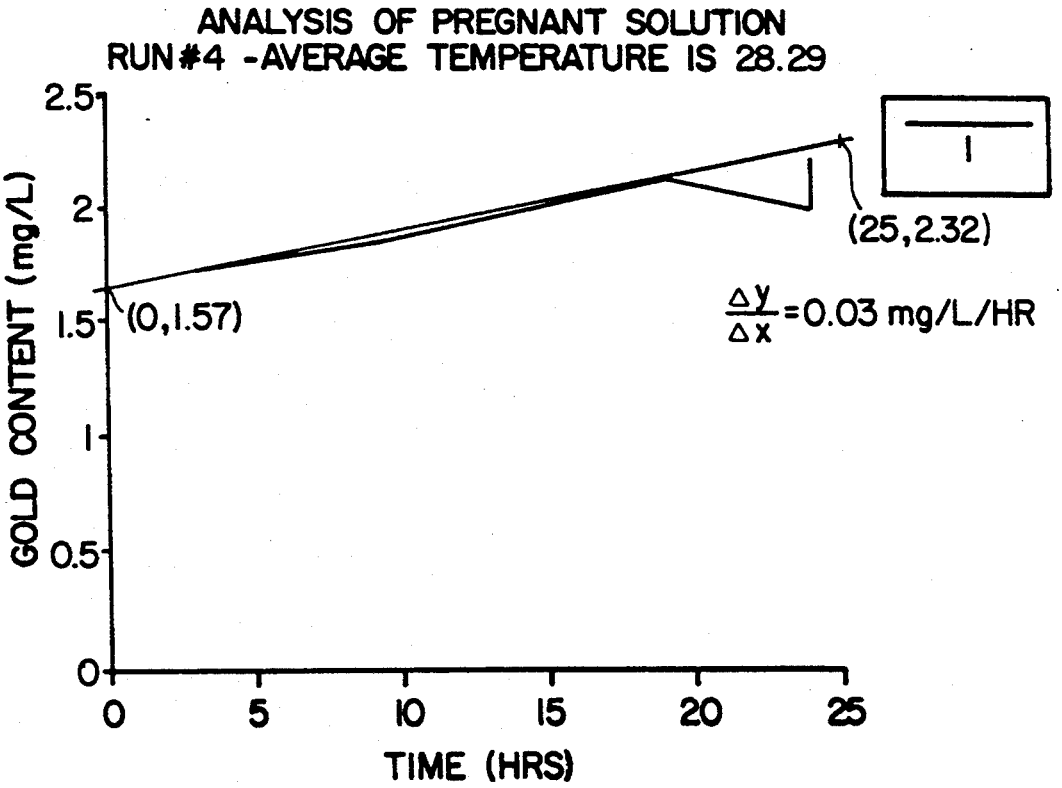
Figure 19:
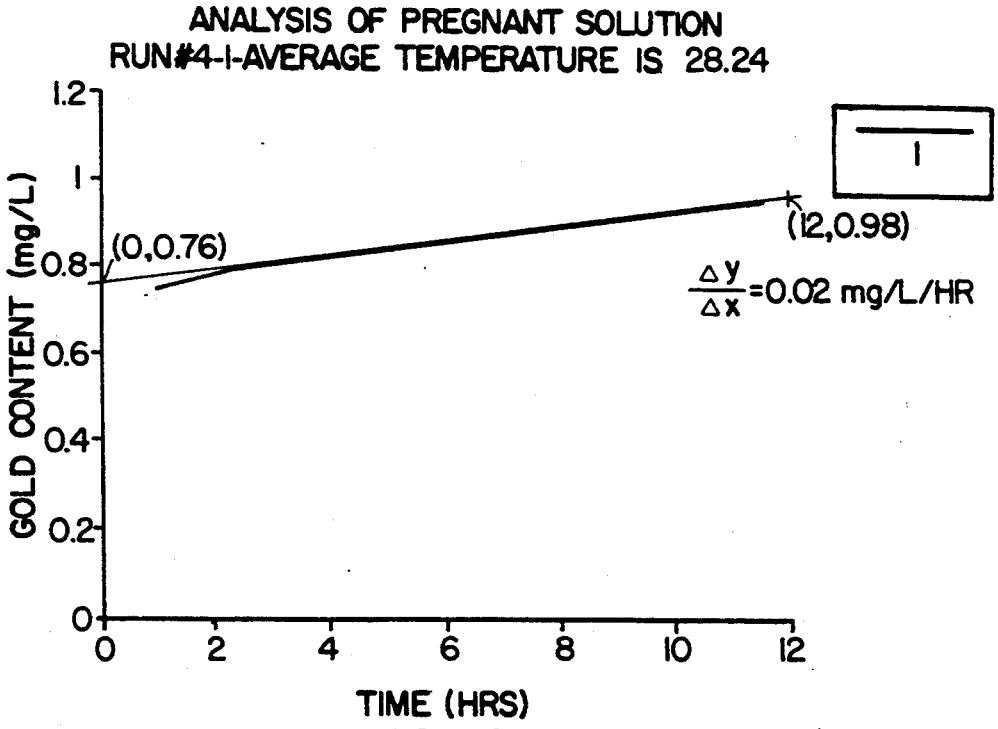
Figure 20:
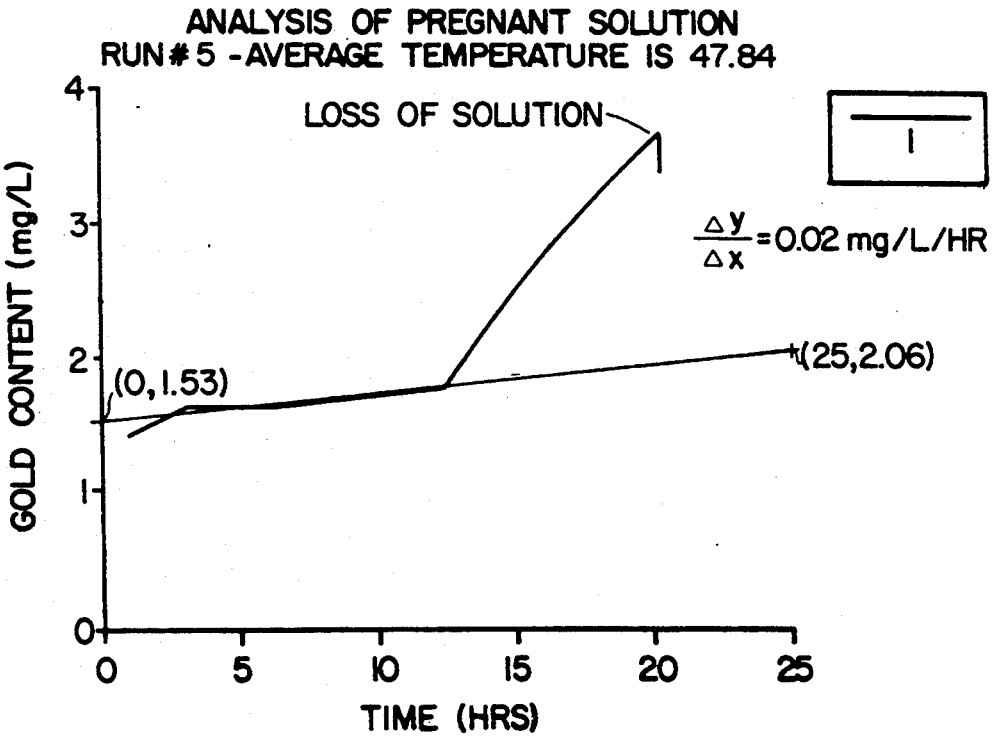
Figure 21:
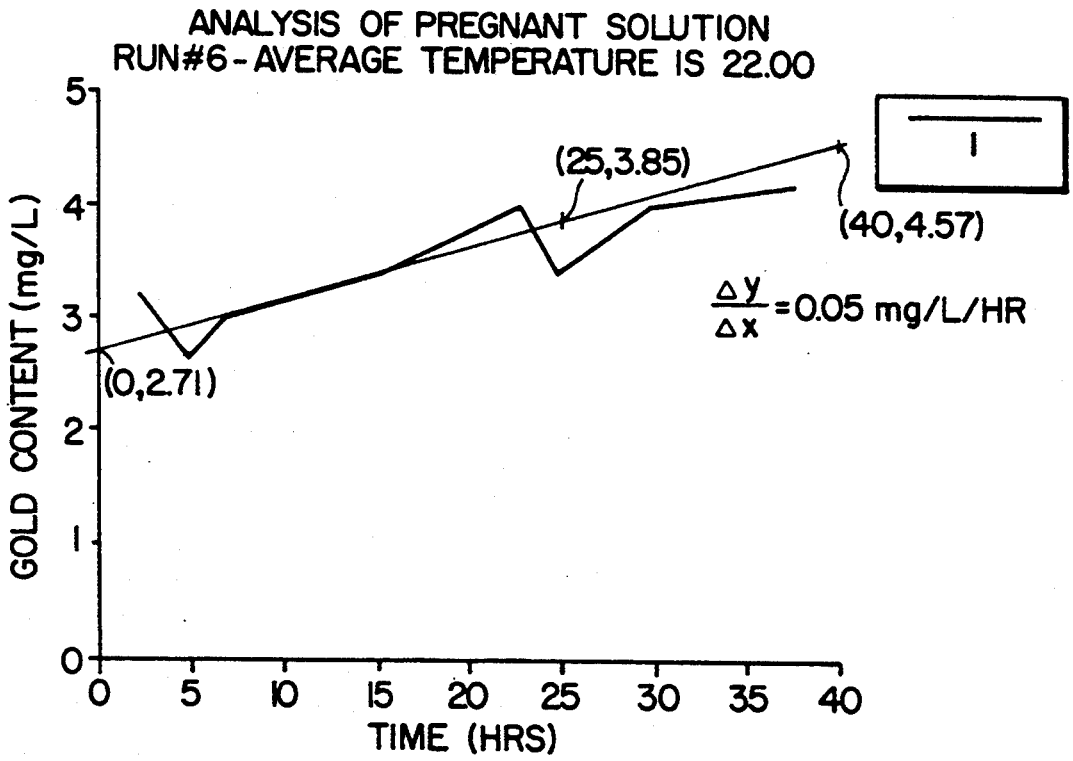

FIG. 13 illustrates a plot of charge/solution temperature against time for Run #5.

| RUN #5 | | | | | | | | |
|---|---|---|---|---|---|---|---|---|
| time(H) | TEMP 1 | TEMP 2 | TEMP 3 | TEMP 4 | SAMPLE # | AVG 2 3 4 | MAX | MIN |
| 0 | 65.2 | 46.1 | 47.3 | 50.9 | | | | |
| 1 | 43.8 | 47.5 | 50.8 | 50.4 | 5-1 | 48.83 | 50.90 | 46.10 |
| 2 | 38.7 | 47.1 | 49.4 | 43.5 | | | | |
| 3 | 35.6 | 44.6 | 46.4 | 38.9 | 5-2 | 44.98 | 49.40 | 38.90 |
| 4 | 51.3 | 42 | 43.2 | 41.9 | | | | |
| 5 | 54.8 | 41.3 | 41.9 | 48 | | | | |
| 6 | 55.9 | 42 | 42.2 | 50.4 | 5-3 | 43.66 | 50.40 | 41.30 |
| 7 | 57.2 | 42.9 | 43.2 | 52.1 | | | | |
| 8 | 57.6 | 43.6 | 44.2 | 53.7 | | | | |
| 9 | 58.3 | 44.1 | 45.2 | 54.2 | | | | |
| 10 | 58.8 | 44.7 | 46 | 54.6 | | | | |
| 11.25 | 58.5 | 45.2 | 47 | 54.2 | | | | |
| 12.25 | 57.6 | 45.7 | 47.4 | 53.7 | 5-4 | 47.87 | 54.60 | 42.90 |
| 13.25 | 56.4 | 45.7 | 47.2 | 52.9 | | | | |
| 14.25 | 57.1 | 45.8 | 49.2 | 52.4 | | | | |
| 15.25 | 59.3 | 47 | 50.4 | 54.6 | | | | |
| 16.25 | 59 | 48.3 | 51.8 | 54.9 | 5-5 | 50.02 | 54.90 | 45.70 |
| 17.25 | 58.9 | 49.5 | 52.4 | 55.1 | | | | |
| 18.25 | 63.8 | 50 | 52.6 | 49.6 | | | | |
| 19.25 | 66.4 | 49.6 | 50.8 | 46 | | | | |
| 20.25 | 48.1 | 48.4 | 48.3 | 43.9 | 5-6//6 | 49.68 | 55.10 | 43.90 |
| 21.25 | 38.4 | 46.8 | 46.6 | 41.3 | | | | |
| 22.25 | 33.4 | 45.3 | 45 | 39.4 | | | | |
| 23.25 | 30.6 | 43.9 | 43.6 | 37.9 | | | | |
| 24.25 | 28.7 | 42.6 | 42.2 | 36.7 | | | | |
| 25.25 | 27.4 | 41.4 | 41 | 35.7 | | | | |
| 26.25 | 25.5 | 40.3 | 39.8 | 34.9 | | | | |
| 27.25 | 24.8 | 39.2 | 38.7 | 34.1 | | | | |
| 28.25 | 24.3 | 38.3 | 37.8 | 33.4 | | | | |
| 29.25 | 23.9 | 37.3 | 36.8 | 32.8 | | | | |
| 30.25 | 23.6 | 36.4 | 36 | 32.2 | | | | |
| 31.25 | 23.2 | 35.6 | 35.2 | 31.7 | | | | |
| 32.25 | 23 | 34.9 | 34.5 | 31.2 | | | | |
| 33.25 | 22.9 | 34.2 | 33.8 | 30.8 | | | | |
| 34.25 | 22.7 | 33.5 | 33.1 | 30.3 | | | | |
| 35.25 | 22.5 | 32.9 | 32.6 | 29.9 | | | | |
| | | AVERAGE SAMPLE TEMPERATURE IS | | | | 47.84 | | |

APPENDIX II

Solution Assays

NOVA GOLD/KURRAY BROOK RESERVE
ANALYSIS OF CYANIDE SOLUTIONS

| SAMPLE # | TIME(Hrs) | Au (mg/L) | Ag (mg/L) |
|---|---|---|---|
| 1 | 0 | 0 | 0 |
| 1-1 | 5 | 1.35 | 4.3 |
| 1-2 | 6 | 1.1 | 4.6 |
| 1-3 | 14 | 1.19 | 5.3 |
| 1-4 | 24 | 1.64 | 6.3 |
| 1-5 | 24 | 1.46 | 6.2 |
| 2 | 0 | 0 | 0 |
| 2-1 | 8 | 1.87 | 9.4 |
| 2-2 | 11 | 1.81 | 8.2 |
| 2-3 | 13 | 2.28 | 9.1 |
| 2-4 | 18 | 2.04 | 10.1 |
| 2-5 | 25 | 2.34 | 11.8 |
| 3 | 0 | 0 | 0 |
| 3-1 | 7 | 1.97 | 6.39 |
| 3-2 | 9 | 2.32 | 6.98 |
| 3-3 | 16 | 1.91 | 8.32 |
| 3-4 | 19 | 1.77 | 8.61 |
| 3-5 | 21 | 1.7 | 9.8 |
| 3-6 | 24 | 2.25 | 9.65 |
| 3 | 0 | 0 | 0 |
| 3--1 | 2 | 0.78 | 2.38 |
| 3--2 | 3 | 0.89 | 2.52 |
| 3--3 | 8 | 0.86 | 3.12 |
| 3--4 | 13 | 0.86 | 3.56 |
| 3--//4 | 13 | 0.86 | 3.56 |
| 3--5 | 24 | 0.95 | 4.31 |
| 3--//5 | 24 | 0.78 | 4.46 |
| 4 | 0 | 0 | 0 |
| 4-1 | 3 | 1.73 | 4.31 |
| 4-2 | 9 | 1.85 | 5.96 |
| 4-3 | 19 | 2.14 | 6.83 |
| 4-4 | 24 | 2.01 | 7.28 |
| 4-//4 | 24 | 2.24 | 7.87 |
| 4--0 | 0 | 0 | 0 |
| 4--1 | 1 | 0.75 | 2.08 |
| 4--2 | 3 | 0.81 | 2.52 |
| 4--3 | 11 | 0.95 | 3.12 |
| 4--4 | 12 | 0.98 | 3.86 |
| 4--//4 | 12 | 1 | |
| 5 | 0 | 0 | 0 |
| 5-1 | 1 | 1.42 | 3.71 |
| 5-2 | 3 | 1.63 | 4.9 |
| 5-3 | 6 | 1.63 | 6.39 |
| 5-4 | 12.25 | 1.77 | 9.8 |
| 5-5 | 26.25 | 2.8 | 10.8 |
| 5-6 | 20.25 | 3.7 | 8.2 |
| 5-//6 | 20.25 | 3.4 | 17.7 |

| | | | | (CONCENTRATION * 2) | |
|---|---|---|---|---|---|
| SAMPLE # | TIME(Hrs) | Au (mg/L) | Ag (mg/L) | Au (ag/L) | Ag (mg/L) |
| 6 | 0 | 0 | 0 | 0 | 0 |
| 6-1 | 2.5 | 1.6 | 3.6 | 3.2 | 7.2 |
| 6-2 | 5 | 1.3 | 2.6 | 2.6 | 5.2 |
| 6-3 | 7 | 1.5 | 2.8 | 3 | 5.6 |
| 6-4 | 15.5 | 1.7 | 3.4 | 3.4 | 6.8 |
| 6-5 | 23 | 2 | 3.4 | 4 | 6.8 |
| 6-6 | 25 | 1.7 | 3.6 | 3.4 | 7.2 |
| 6-7 | 30 | 2 | 3 | 4 | 6 |
| 6-8 | 38 | 2.1 | 3 | 4.2 | 6 |
| 6-9(SUMP) | 38 | — | — | — | — |

The results from these cyanide solution analyses are summarized in FIGS. 14–21.

While the invention has been described in connection with a specific embodiment thereof and in a specific use, various modifications thereof will occur to those skilled in the art without departing from the spirit and scope of the invention as set forth in the appended claims.

The terms and expressions which have been employed in the specification are used as terms of description and not of limitations, and there is no intention in the use of such terms and expressions to exclude any equivalents of the features shown and described or portions thereof.

The embodiments of the invention in which an exclusive property or privilege is claimed are defined as follows:

1. A method of enhancing the agglomeration of ores, comprising the steps of:

(a) heating the ore from a first temperature to a second temperature which is higher that said first temperature, said second temperature being within the range of 14° C. and 60° C.; and (b) mixing the heated ore with an agglomerating agent and effecting agglomeration of the mixture by use of an agglomerating apparatus, thereby to form an agglomerate.

2. A method as claimed in claim 1 wherein the ore is heated to a temperature between 15° C. and 45° C.

3. A method as claimed in claim 1 wherein the ore is heated to a temperature between 25° C. and 45° C.

4. A method as claimed in claim 1 further comprising the step of leaching minerals from said agglomerated ore with a leaching solution wherein said heating of the comminuted ore is such as to result in a steady state leach solution temperature in the range of 25° C. to 85° C.

5. A method as claimed in claim 4 wherein said steady state solution temperature is in the range of 30° C. to 85° C.

6. A method of improving the rate and amount of recovery of minerals from comminuted ore in a leaching process which includes an agglomeration step, comprising the steps of:

(a) heating the ore from a first temperature to a second temperature which is higher that said first temperature, said second temperature being within the range of 14° C. and 60° C.; and (b) mixing the heated ore with an agglomerating agent and effecting agglomeration of the mixture by use of an agglomerating apparatus, thereby to form an agglomerate.

7. A method as claimed in claim 6 wherein the ore is heated to a temperature between 15° C. to 45° C.

8. A method as claimed in claim 6 wherein the ore is heated to a temperature between 25° C. to 45° C.

9. A method as claimed in claim 6 further comprising the step of leaching minerals from said agglomerate ore with a leaching solution, wherein said heating of the comminuted ore is such as to result in a steady state leach solution temperature in the range of 25° C. to 85° C.

10. A method as claimed in claim 9 wherein said steady state solution temperature is in the range of 30° C. to 85° C.

11. A method as claimed in claim 1 wherein said agglomerating agent is selected from the group consisting of:

a) water;

b) a mixture of lime and/or cement with water; and c) a solution of sodium hydroxide.

12. A leaching process for extracting minerals from comminuted mineral-containing ore, comprising the steps of:

(a) heating the ore from a first temperature to a second temperature which is higher that said first temperature, said second temperature being within the range of 14° C. and 60° C.; and (b) mixing the heated ore with an agglomerating agent and effecting agglomeration of the mixture by use of an agglomerating apparatus, thereby to form an agglomerate;

(c) curing the agglomerate;

(d) leaching said minerals from said agglomerate with leaching solution; and (e) separating said minerals from said leaching solution.

13. A process as claimed in claim 12 wherein the ore is heated to a temperature between 15° C. and 45° C.

14. A process as claimed in claim 12 wherein the ore is heated to a temperature between 25° C. and 45° C.

15. A process as claimed in claim 12 wherein said heating of the comminuted ore is such as to result in a steady state leach solution temperature in the range of 25° C. to 85° C.

16. A process as claimed in claim 15 wherein said steady state solution temperature is in the range of 30° C. to 85° C.

17. A process as claimed in claim 12 wherein said agglomerating agent is selected from the group consisting of:

a) water;

b) a mixture of lime and/or cement with water; and c) a solution of sodium hydroxide.

* * * * *